US010107158B2

(12) United States Patent
Schmidgall

(10) Patent No.: US 10,107,158 B2
(45) Date of Patent: Oct. 23, 2018

(54) OIL COOLER

(71) Applicant: Mahle International GmbH, Stuttgart (DE)

(72) Inventor: Stefan Schmidgall, Stuttgart (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/568,723

(22) PCT Filed: Apr. 19, 2016

(86) PCT No.: PCT/EP2016/058619
§ 371 (c)(1),
(2) Date: Oct. 23, 2017

(87) PCT Pub. No.: WO2016/169916
PCT Pub. Date: Oct. 27, 2016

(65) Prior Publication Data

US 2018/0163586 A1 Jun. 14, 2018

(30) Foreign Application Priority Data

Apr. 24, 2015 (DE) ..... 10 2015 207 593

(51) Int. Cl.
*F01M 5/00* (2006.01)
*F28F 3/00* (2006.01)
*F01M 11/03* (2006.01)

(52) U.S. Cl.
CPC ..... *F01M 5/002* (2013.01); *F01M 5/007* (2013.01); *F01M 2005/004* (2013.01); *F01M 2011/033* (2013.01)

(58) Field of Classification Search
CPC .. F01P 2060/04; F01P 2025/40; F01M 5/007; F01M 11/03; F01M 2011/033;
(Continued)

(56) References Cited

U.S. PATENT DOCUMENTS 6,182,749 B1 2/2001 Brost et al.
7,748,442 B2 * 7/2010 Kalbacher ..... F01M 5/002 165/166

(Continued)

FOREIGN PATENT DOCUMENTS

DE 19750814 A1 6/1999
DE 202005017975 U1 1/2007

(Continued)

OTHER PUBLICATIONS

English abstract for DE-102005048294.

(Continued)

*Primary Examiner* — Long T Tran
(74) *Attorney, Agent, or Firm* — Fishman Stewart PLLC

(57) ABSTRACT

An oil cooler may include at least two heat exchanger plates stacked in a stacking direction, and a cover plate. A fluid channel may extend between the cover plate and the adjacent heat exchanger plate. A thermostatic valve may be connected to the fluid channel in a fluid-transmitting manner via a thermostatic valve housing of the thermostatic valve. The cover plate may include at least two connecting pieces or an adapter plate may be arranged between the cover plate and the thermostatic valve housing and may include at least two connecting pieces. The thermostatic valve housing may include at least two connecting pieces configured complementary to the at least two connecting pieces of the cover plate or the adapter plate, and secured therein. The at least two pieces of the thermostatic valve housing may be soldered in the at least two connecting pieces of the cover plate or the adapter plate.

20 Claims, 3 Drawing Sheets

(58) Field of Classification Search
CPC .... F28F 27/02; F28F 9/001; F28F 9/22; F28F 9/00; F28F 9/0075
See application file for complete search history.

(56) References Cited

U.S. PATENT DOCUMENTS

| | | | | |
|---|---|---|---|---|
| 9,410,745 | B2 * | 8/2016 | Katoh | F28D 7/0008 |
| 2008/0210410 | A1 * | 9/2008 | Kalbacher | F01M 5/002 165/157 |
| 2012/0273177 | A1 | 11/2012 | Kim et al. | |
| 2013/0319634 | A1 | 12/2013 | Sheppard et al. | |
| 2017/0030456 | A1 * | 2/2017 | Zou | F01M 5/007 |
| 2017/0299045 | A1 * | 10/2017 | Kim | F16K 31/002 |

FOREIGN PATENT DOCUMENTS

| | | | |
|---|---|---|---|
| DE | 102005048294 | A1 | 4/2007 |
| DE | 102008020609 | A1 | 10/2009 |
| EP | 1559980 | A1 | 8/2005 |
| FR | 2853725 | A1 | 10/2004 |
| WO | WO-9700415 | A1 | 1/1997 |
| WO | WO-2012066404 | A2 | 5/2012 |

OTHER PUBLICATIONS

English abstract for DE-102008020609.
English abstract for DE-202005017975.
English abstract for FR-2853725.

* cited by examiner

OIL COOLER

CROSS-REFERENCE TO RELATED APPLICATIONS

This application claims priority to PCT/EP2016/058619 filed on Apr. 19, 2016, which also claims priority to DE 10 2015 207 593.1 filed on Apr. 24, 2015, the contents of which are hereby incorporated by reference in their entirety.

TECHNICAL FIELD

The present invention relates to an oil cooler comprising at least two heat exchanger plates stacked one over the other in stacking direction, and cover plate. The invention relates in addition to a method for producing such an oil cooler and a motor vehicle with such an oil cooler.

BACKGROUND

From EP 1 559 980 a generic oil cooler comprising at least two heat exchanger plates stacked one over the other in stacking direction, and a cover plate, is known, wherein a fluid channel extends between the cover plate and the adjacent heat exchanger plate. Furthermore, a thermostatic valve is provided, which is connected to the fluid channel of the cover plate in a fluid-transmitting manner by means of its thermostatic valve housing.

From DE 10 2008 020 609 A1 a further oil cooler is known, comprising cooling channels, arranged in a housing, and a bypass which is able to be closed by a bypass valve. The valve body of the bypass valve is directed through an opening in the housing and projects in transverse direction into the bypass channel. Hereby, a variably usable oil cooler is to be able to be created.

From DE 10 2005 048 294 A1 a further oil cooler is known, comprising stacked heat exchanger plates with at least two openings, whereby the two openings form two corresponding channels and wherein flow channels are formed, in intervals between the heat exchanger plates preferably standing perpendicularly to the channels, which flow channels are connected hydraulically to the channels. Furthermore, a valve element is provided, which opens or respectively closes one of the channels in order to direct medium, for example oil, flowing there, either through the flow channels or through a bypass channel.

Generally, in oil coolers known hitherto from the prior art, it is known to manufacture a thermostatic valve separately and to install this onto a finished soldered heat exchanger block. For this, of course a sealed connection must be created between the heat exchanger block and the thermostatic valve, which must be monitored and verified by means of laborious leakage tests, in this case even double leakage tests. Here, firstly the heat exchanger block is subjected to a leakage test and subsequently the structural unit of heat exchanger block and thermostatic valve housing are subjected to a further leakage test.

SUMMARY

The present invention is therefore concerned with the problem of indicating for an oil cooler of the generic type an improved or at least an alternative embodiment, by means of which in particular the oil cooler is able to be produced at a more favourable cost.

This problem is solved according to the invention by the subjects of the independent claims. Advantageous embodiments are the subject of the dependent claims.

The present invention is based on the general idea of producing a thermostatic valve housing from a material which is able to be soldered very well and to connect it, before the actual soldering, to a heat exchanger block of an oil cooler, so that subsequently the entire heat exchanger block together with the thermostatic valve housing can be soldered reliably and in a sealed manner in a soldering furnace. Subsequently, it can be monitored with only one single leakage test. The oil cooler according to the invention has here in a known manner at least two heat exchanger plates, stacked one over the other in stacking direction, and a cover plate. A fluid channel extends here between the cover plate and the adjacent heat exchanger plate, wherein the thermostatic valve is connected to the fluid channel of the cover plate in a fluid-tight manner by means of its thermostatic valve housing. According to the invention, the cover plate now has two connecting pieces, flared and thereby protruding in the direction of the thermostatic valve, with a respective edge. The thermostatic valve housing itself is formed from an aluminium profiled element, in particular from an aluminium extrusion profiled element or a rolled aluminium profiled element, which is separately finished and in particular is even finish-processed. Through the embodiment of the thermostatic valve housing from a material which is suitable in particular for an extruding or rolling, an aluminium alloy can be used which is able to be soldered without difficulty. The thermostatic valve housing has in addition two pieces formed complementary to the connecting pieces, which pieces are fastened mechanically in the connecting pieces of the cover plate before the actual soldering. Here, the pieces can be fastened in the connecting pieces of the cover plate by means of a press fit, for example caulked or wobble-riveted. The thermostatic valve housing is soldered here with its pieces in the connecting pieces of the cover plate, wherein this soldering, after the fastening together with the soldering of the heat exchanger block takes place in the soldering furnace. Through the mechanical fastening of the pieces of the thermostatic valve housing in the connecting pieces of the cover plate, an additionally necessary soldering foil can also be dispensed with, because the necessary solder provision for the sealed soldering between thermostatic valve housing and cover plate can be provided by the cover plate, solder-plated on one side. With the oil cooler produced according to the invention, this can be constructed not only at a more favourable cost, because for example separate sealing elements or a double leakage test (once for the heat exchanger block separately and the other time in installed state) can be dispensed with, but also a solder foil. In the oil cooler according to the invention, fastening elements can also be dispensed with, because through the mechanical and, at the same time, material connection between the thermostatic valve housing and the heat exchanger block, a reliable fastening of the two components to one another can be guaranteed.

Alternatively, the thermostatic valve housing can in fact also be constructed from a finished aluminium profiled element, however between the cover plate and the thermostatic valve housing in addition an adapter plate is arranged. The latter has two connecting pieces, protruding in the direction of the thermostatic valve, with an edge, wherein the thermostatic valve housing has two pieces formed complementary to the connecting pieces, which pieces are fastened mechanically in the connecting pieces of the adapter plate and wherein the pieces of the thermostatic valve housing are soldered in connecting pieces of the adapter plate. With the adapter plate, an increase of rigidity can be achieved. However, even further advantages can be realized with the adapter plate, namely in particular the arrangement of the connecting pieces such that the thermostatic valve housing does not have to be aligned to the connecting pieces of the cover plate lying rather far apart, but rather can be kept short and thereby light, optimizing the installation space and at a favourable cost. For this, for example, deflection channels can be formed into the adapter plate. Hereby, also, an almost freely selectable positioning of the thermostatic valve on the adapter plate of the oil cooler is possible, whereby external circumstances can be better taken into account.

In an advantageous further development of the solution according to the invention, the respective edge of the connecting piece has a conical inner contour, wherein additionally or alternatively provision is made that an outer contour of the pieces tapers towards a free end. This can be provided for example in the manner of a chamfer. Both such a taper/chamfer and also the conical edge, formed in the connecting piece, facilitates on the one hand the introducing of the piece of the thermostatic valve housing in the connecting piece of the cover plate or of the adapter plate, likewise a jamming or respectively caulking of the pieces in the connecting pieces. With the said methods, the manufacture can thereby be simplified and, at the same time, improved.

In an advantageous further development of the solution according to the invention, the cover plate has, on its side facing away from the adjacent heat exchanger plate, a solder plating. Such a solder plating is present in any case on the cover plate, in order to be able to reliably solder it to the adjacent heat exchanger plate. In the oil cooler according to the invention, this solder plating is, however, additionally used in order to be able to guarantee a sealed soldering between the connecting pieces on the cover plate and the pieces on the thermostatic valve housing. In the same way, the adapter plate can also have a solder plating on its side facing away from the adjacent cover plate.

The present invention is further based on the general idea of indicating a method for the production of a previously described oil cooler, in which firstly the thermostatic valve housing is produced as an aluminium extrusion solid profiled element, for example of cuboid shape. The corresponding inner channels are now subsequently introduced into this aluminium extrusion profiled element, for example by drilling, and the outer contours, in particular the pieces, are created for example by milling or laser cutting. All in all, the previously described working steps can be combined in a subsuming manner under the term finishing or respectively finish-processing of the thermostatic valve housing. Subsequently, at least two heat exchanger plates, stacked one over the other in stacking direction, are covered by the cover plate, wherein previously or thereafter the thermostatic valve housing is fastened mechanically with its two pieces in the connecting pieces of the cover plate, in particular is caulked, and is thereby pre-fastened. The entire heat exchanger block with cover plate and heat exchanger plates and the thermostatic valve housing fastened in the cover plate are now jointly soldered in the soldering furnace and are thereby connected to one another in a sealed manner. Subsequently, further components such as, for example, at least one wax expansion element and/or a spring and a valve body can be incorporated into the thermostatic valve housing and the latter can be closed by means of a cover. The great advantage in the method according to the invention is that the soldering both of the heat exchanger block and also of the thermostatic valve housing takes place jointly in a single working step and thereby also only one leakage test, following therefrom, is necessary.

If, alternatively, in addition an adapter plate is provided, then at least two heat exchanger plates, stacked one over the other in stacking direction, are covered by the cover plate and the adapter plate, wherein previously or thereafter, the thermostatic valve housing is fastened with its two pieces in the connecting pieces of the adapter plate, in particular is caulked or wobble-riveted. Subsequently, the heat exchanger plates, the cover plate, the adapter plate and the thermostatic valve housing are jointly soldered.

Expediently, a soldering of the oil cooler takes place by the CAB method (Controlled Atmosphere Brazing) or under vacuum. The so-called CAB method has already been used for many years in the production of aluminium heat exchangers, such as for example oil coolers, and is thereby both fully developed and also well-proven.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 1:
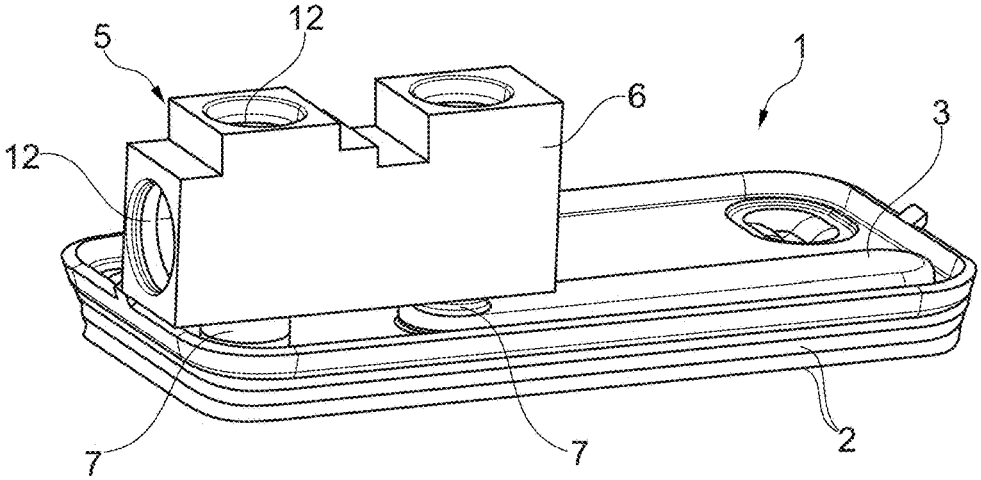
FIG. 1 a view onto an oil cooler according to the invention with a thermostatic valve housing arranged on a cover plate.
Figure 5:
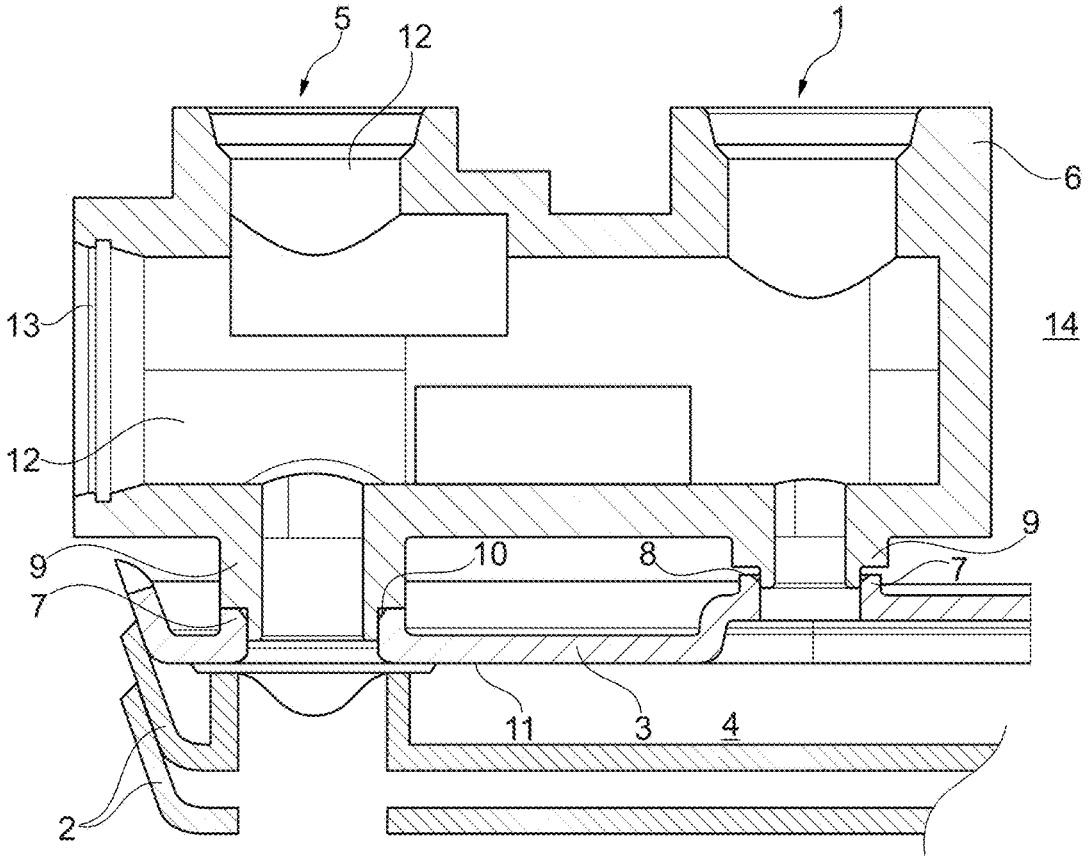
FIG. 5 a sectional illustration through the oil cooler in the region of the cover plate and of the thermostatic valve housing soldered thereon.

According to FIGS. 1 and 5, an oil cooler 1 according to the invention has at least two heat exchanger plates 2 stacked one over the other in stacking direction, and a cover plate 3. Generally, the term oil cooler 1, used previously and in the following, is also to comprise other heat exchangers by means of which other fluids are cooled or temperature-controlled. Such an oil cooler 1 is used for example in a utility vehicle 14. A fluid channel 4 extends between the cover plate 3 and the adjacent heat exchanger plate 2. Furthermore, a thermostatic valve 5 is provided, which is connected to the fluid channel 4 of the cover plate 3 in a fluid-transmitting manner by means of its thermostatic valve housing 6. Observing now FIGS. 1, 2 and 5, it can be seen that the cover plate 3 has two connecting pieces 7 protruding in the direction of the thermostatic valve 5, with an edge 8, whereas the thermostatic valve housing 6 has two pieces 9 formed complementary to the connecting pieces 7, which pieces are fastened mechanically in the connecting pieces 7 of the cover plate, in particular are caulked. According to the invention, the thermostatic valve housing 6 is now formed from a finished aluminium profiled element, in particular from a finished aluminium extrusion profiled element or from a rolled aluminium profiled element and is thereby produced from an aluminium alloy which can be soldered in an optimum manner. The thermostatic valve housing 6 is soldered here via its pieces 9 in the connecting pieces 7 of the cover plate 3.

Figure 6:
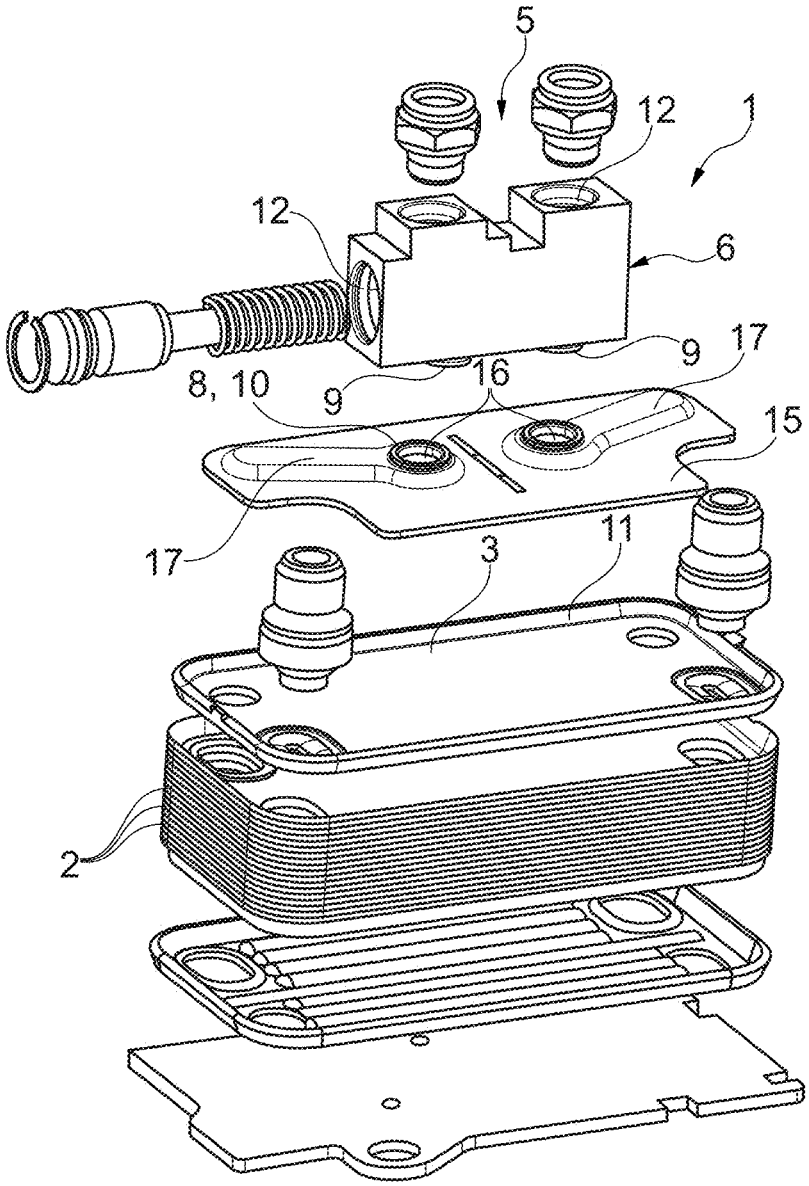
FIG. 6 an exploded illustration of an oil cooler according to the invention with an additional adapter plate.

Observing FIG. 6, it can be seen in the embodiment which is illustrated there that an adapter plate 15 is arranged between the cover plate 3 and the thermostatic valve housing 6, wherein the thermostatic valve housing 6 is soldered with its pieces 9 in connecting pieces 16 of the adapter plate 15. The adapter plate 15 has in this case two connecting pieces 16, protruding in the direction of the thermostatic valve 5, with an edge 8, wherein the thermostatic valve housing 6 with its pieces 9 is fastened mechanically in the connecting pieces 16 of the adapter plate. The adapter plate 15 is soldered here onto the cover plate 3, whereby additionally also an increase in the rigidity can be achieved. However, further advantages can be additionally realized with the adapter plate 15, namely in particular the arrangement of the connecting pieces 16 such that the thermostatic valve housing 6 does not have to be aligned to the connecting pieces 7 of the cover plate 3 lying rather far apart, but rather can be kept short and thereby light, optimizing the installation space and at a favourable cost. For this, for example, deflection channels 17 can be formed into the adapter plate 15. If these deflection channels 17 were formed directly into the cover plate 3, this could, under some circumstances, have a disadvantageous effect on the stability of the oil cooler 1. Hereby, an almost freely selectable positioning of the thermostatic valve 5 on the adapter plate 15 of the oil cooler 1 is possible, whereby external circumstances can be better taken into consideration.

Figure 2:
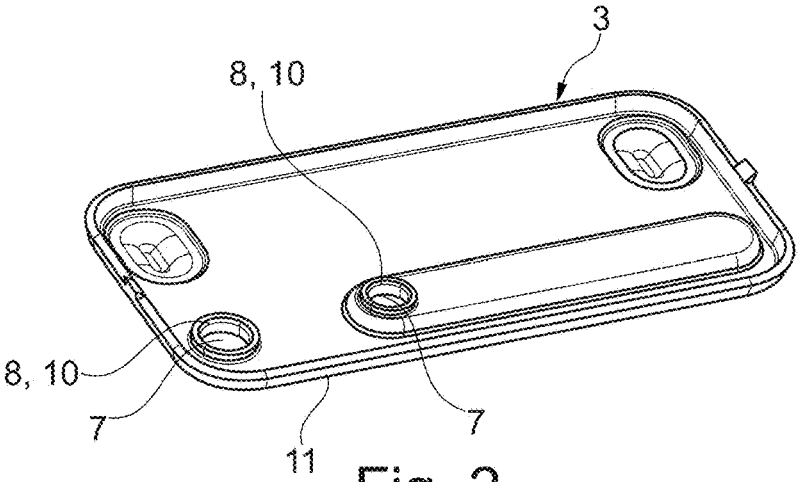
FIG. 2 a view onto the cover plate.

Observing in particular FIGS. 2, 5 and 6, it can be seen that the respective edge 8 of the connecting piece 7, 16 has a conical inner contour 10, in particular in the manner of a chamfer, wherein additionally or alternatively the pieces 9 can taper towards a free end. Both the conical inner contour 10 and also the tapering pieces 9 can facilitate here the introducing of the pieces 9 into the connecting pieces 7, 16, likewise a fastening, in particular a caulking, of the pieces 9 in the connecting pieces 7, 16. On its side facing the adjacent heat exchanger plate 2, the cover plate 3 has a solder plating 11, whereby an additional solder addition during soldering of the thermostatic valve housing 6 to the cover plate 3 can be dispensed with.

Figure 3:
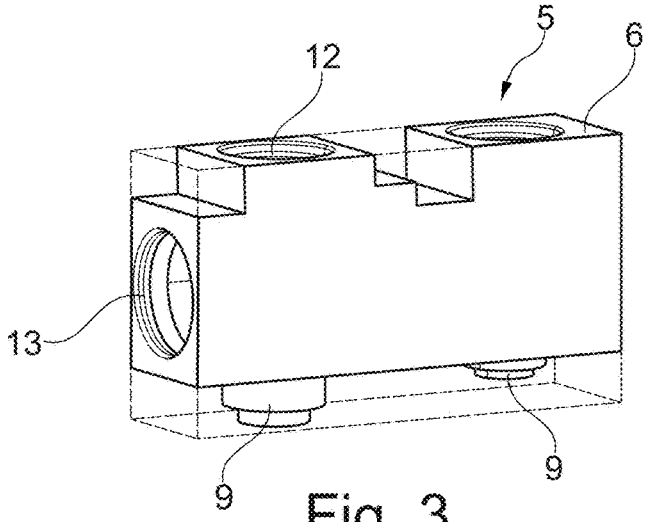
FIG. 3 a view onto the thermostatic valve housing.
Figure 4:
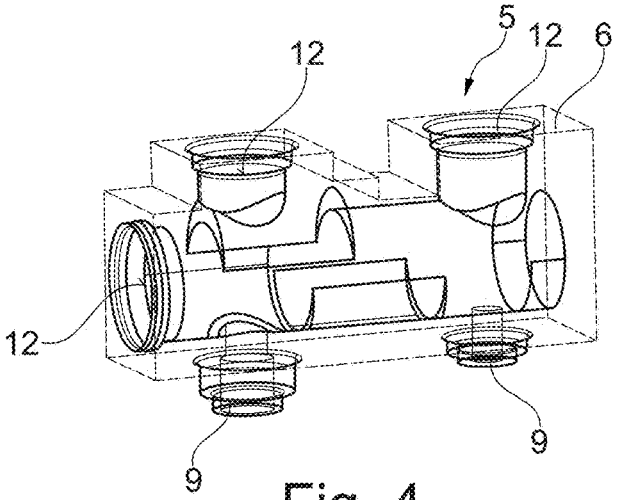
FIG. 4 an illustration as in FIG. 3, but with indicated inner contours.

The oil cooler 1 according to the invention is produced as follows:

Firstly, the thermostatic valve housing 6 is produced as an aluminium profiled element, in particular as an aluminium extrusion profiled element, wherein for example the outer contours of the thermostatic valve housing 6, produced as a solid profiled element, in particular extruded or rolled, is illustrated in FIG. 3 with a broken line. Subsequently, for example inner channels 12 and also the external pieces 9 or respectively further components of the thermostatic valve housing 6 are produced by finishing of the aluminium solid profiled element, for example by drilling, milling and/or grinding. For the further production of the oil cooler 1, at least two heat exchanger plates 2, stacked one over the other in stacking direction, are now covered by the cover plate 3, wherein previously or thereafter the thermostatic valve housing 6 is fastened with its two pieces 9 in the connecting pieces 7 of the cover plate 3, in particular is caulked wobble-riveted. The composite of thermostatic valve housing 6, cover plate 3 and heat exchanger plates 2 shown for example according to FIG. 1 can now be soldered in a single working step in a corresponding soldering furnace. Purely theoretically, it is also conceivable that the thermostatic valve housing 6 is soldered without mechanical pre-fastening and without pieces 9 directly to the connecting pieces 7 of the cover plate 3.

If alternatively in addition an adapter plate 15 is provided, then at least two heat exchanger plates 2, stacked one over the other in stacking direction, are covered by the cover plate 3 and the adapter plate 15, wherein previously or thereafter the thermostatic valve housing 6 is fastened with its two pieces 9 in the connecting pieces 16 of the adapter plate 15, in particular is caulked or wobble-riveted. Subsequently, the heat exchanger plates 2, the cover plate 3, the adapter plate 15 and the thermostatic valve housing 6 are jointly soldered. In this case, of course no separately formed connecting pieces 7 have to be provided on the cover plate 3.

The great advantage of this production is based on the fact that owing to the material selection for the thermostatic valve housing 6 (aluminium alloy capable of extrusion), a sealed soldering between the thermostatic valve housing 6 and the cover plate 3 or respectively the adapter plate 15 can be achieved without, for example, separate seals being necessary for this. Through the soldering jointly, also only one single leakage test is now sufficient, whereas in oil coolers known from the prior art, the tightness of the heat exchanger block and in addition also the tightness of the structural unit consisting of heat exchanger block and installed thermostatic valve had to be checked.

When the soldering process has been completed, further components can be incorporated into the thermostatic valve housing 6, such as for example a wax expansion element, a spring and a valve body, wherein this is subsequently closed by means of a cover which is not shown. Such a cover, for example, can be screwed into the thermostatic valve housing 6, for which for example a corresponding internal thread 13 is provided. A soldering of the thermostatic valve housing 6 with the cover plate 3, if applicable with the adapter plate 15 and the heat exchanger plates 2, takes place here usually by the so-called CAB method (Controlled Atmosphere Brazing) or under vacuum, wherein in particular the first-mentioned soldering method has already been used for many years in the producing of aluminium heat exchangers and is thereby well-proven. With the thermostatic valve housing 6, produced according to the invention for the first time from an aluminium solid profiled element, a distinct simplification of the installing of the oil cooler 1 can be achieved, because the thermostatic valve housing 6 is firstly pre-fastened via its pieces 9 in the connecting pieces 7 or 16, and is subsequently soldered together with the oil cooler 1 in the soldering furnace. Hereby, in particular, a hitherto necessary additional leakage test can be dispensed with, likewise additional sealing elements or fastening means, for examples screws, because the thermostatic valve housing 6, which is caulked and soldered on the cover plate 3 or on the adapter plate 15, is sufficiently fastened to the cover plate 3 or to the adapter plate 15.

The invention claimed is:

1. An oil cooler comprising:

at least two heat exchanger plates stacked one over the other in a stacking direction, and a cover plate;

a fluid channel extending between the cover plate and an adjacent one of the at least two heat exchanger plates;

a thermostatic valve connected to the fluid channel in a fluid-transmitting manner via a thermostatic valve housing of the thermostatic valve; wherein:

the thermostatic valve housing is a finished aluminium profiled element;

the cover plate includes at least two connecting pieces protruding in a direction of the thermostatic valve, the at least two connecting pieces of the cover plate each having an edge;

the thermostatic valve housing including at least two connecting pieces configured complementary to the at least two connecting pieces of the cover plate and secured mechanically in the at least two connecting pieces of the cover plate; and the at least two connecting pieces of the thermostatic valve housing are soldered in the at least two connecting pieces of the cover plates;

or an adapter plate is arranged between the cover plate and the thermostatic valve housing;

the adapter plate including at least two connecting pieces protruding in the direction of the thermostatic valve, the at least two connecting pieces of the adapter plate each having an edge;

the thermostatic valve housing including the at least two connecting pieces configured complementary to the at least two connecting pieces of the adapter plate and secured mechanically in the at least two connecting pieces of the adapter plate; and wherein the at least two connecting pieces of the thermostatic valve housing are soldered in the at least two connecting pieces of the adapter plate.

2. The oil cooler according to claim 1, wherein at least one of:

the edge of each of the at least two connecting pieces of the cover plate or the adapter plate have a conical inner contour; and the at least two connecting pieces of the thermostatic valve housing have an outer contour that tapers towards a free end.

3. The oil cooler according to claim 1, wherein a first side of the cover plate facing the adjacent one of the at least two heat exchanger plates includes a solder plating.

4. The oil cooler according to claim 1, wherein the thermostatic valve housing is a finished aluminium extrusion profiled element or a rolled profiled element.

5. The oil cooler according to claim 1, wherein the thermostatic valve housing including the at least two connecting pieces is secured via a press fit in the at least two connecting pieces of the cover plate or in the at least two connecting pieces of the adapter plate.

6. The oil cooler according to claim 1, wherein the at least two connecting pieces of the thermostatic valve are one of caulked or wobble riveted to the at least two connecting pieces of the cover plate.

7. The oil cooler according to claim 1, wherein the at least two connecting pieces of the thermostatic valve are one of caulked or wobble riveted to the at least two connecting pieces of the adapter plate.

8. The oil cooler of claim 1, wherein the cover plate has the at least two connecting pieces protruding in the direction toward the thermostatic valve;

the thermostatic valve housing including at least two connecting pieces configured to be complementary to the at least two connecting pieces of the cover plate and secured mechanically to the at least two connecting pieces of the cover plate; and wherein the at least two connecting pieces of the thermostatic valve housing are soldered in the at least two connecting pieces of the cover plate.

9. The oil cooler according to claim 8, wherein the thermostatic valve housing is mechanically secured to the cover plate via press fitting the at least two connecting pieces of the thermostatic valve housing to the at least two connecting pieces of the cover plate.

10. The oil cooler of claim 1, wherein the adapter plate is arranged between the cover plate and the thermostatic valve housing;

the adapter plate having at least two connecting pieces protruding in the direction towards the thermostatic valve;

the thermostatic valve housing having the at least two connecting pieces configured to be complementary to the at least two connecting pieces of the adapter piece; and wherein the at least two connecting pieces of the thermostatic valve housing are soldered in the at least two connecting pieces of the adapter plate.

11. The oil cooler according to claim 10, wherein the thermostatic valve housing is mechanically secured to the adapter piece via press fitting the at least two connecting pieces of the thermostatic valve housing into the at least two connecting pieces of the adapter plate.

12. The oil cooler according to claim 10, wherein the adaptor plate further comprises at least one deflection channel.

13. A method for producing an oil cooler comprising:

producing a thermostatic valve housing including at least two connecting pieces as an aluminium extrusion solid profiled element or a rolled aluminium solid profiled element;

finish-processing the thermostatic valve housing via at least one of drilling, milling, and grinding a plurality of inner channels and the at least two connecting pieces on the thermostatic valve housing;

providing at least two heat exchanger plates stacked one over the other in a stacking direction, covering the at least two heat exchanger plates with a cover plate, securing the at least two connecting pieces of the thermostatic valve housing in at least two connecting pieces of the cover plate, or providing at least two heat exchanger plates stacked one over the other in a stacking direction, covering the at least two heat exchanger plates with a cover plate and an adapter plate arranged between the cover plate and the thermostatic valve housing, securing the at least two connecting pieces of the thermostatic valve housing in at least two connecting pieces of the adapter plate; and jointly soldering the at least two heat exchanger plates, the cover plate, and the thermostatic valve housing together, or jointly soldering the at least two heat exchanger plates, the cover plate, the adapter plate and the thermostatic valve housing together.

14. The method according to claim 13, wherein jointly soldering is performed via one of a Controlled Atmosphere Brazing method or under a vacuum.

15. The method according to claim 13, further comprising:

incorporating at least one of a wax expansion element and a spring and a valve body into the thermostatic valve housing, and closing the thermostatic valve housing via a cover.

16. The method according to claim 13, further comprising forming an outer tapered contour on at least one edge of the at least two connecting pieces of the thermostatic valve housing.

17. The method according to claim 13, further comprising forming a conical inner contour on at least one edge of the at least two connecting pieces of the cover plate.

18. The method according to claim 13, further comprising forming at least one of a conical inner contour on at least one edge of the at least two connecting pieces of the adapter plate.

19. The method according to claim 13, further comprising providing a soldering plating on a first side of the cover plate facing the adjacent heat exchanger plate.

20. A motor vehicle, comprising:

at least one oil cooler, the at least one oil cooler including:

at least two heat exchanger plates stacked one over the other in a stacking direction, and a cover plate;

a fluid channel extending between the cover plate and an adjacent one of the at least two heat exchanger plates;

a thermostatic valve connected to the fluid channel in a fluid-transmitting manner via a thermostatic valve housing of the thermostatic valve; wherein:

the thermostatic valve housing is a finished aluminium profiled element;

the cover plate includes at least two connecting pieces protruding in a direction of the thermostatic valve, the at least two connecting pieces of the cover plate each having an edge;

the thermostatic valve housing including at least two connecting pieces configured complementary to the at least two connecting pieces of the cover plate and secured mechanically in the at least two connecting pieces of the cover plate; and the at least two connecting pieces of the thermostatic valve housing are soldered in the at least two connecting pieces of the cover plate;

or an adapter plate is arranged between the cover plate and the thermostatic valve housing;

the adapter plate including at least two connecting pieces protruding in the direction of the thermostatic valve, the at least two connecting pieces of the adapter plate each having an edge;

the thermostatic valve housing including the at least two connecting pieces configured complementary to the at least two connecting pieces of the adapter plate and secured mechanically in the at least two connecting pieces of the adapter plate; and wherein the at least two connecting pieces of the thermostatic valve housing are soldered in the at least two connecting pieces of the adapter plate.

* * * * *